US012798730B2

(12) United States Patent
Chen

(10) Patent No.: US 12,798,730 B2
(45) Date of Patent: Nov. 17, 2026

(54) WATER FLOATING BODY DEVICE

(71) Applicant: Sunny Rich Agric. & Biotech Co., Ltd., Taipei City (TW)

(72) Inventor: Kuei-Kuang Chen, Taipei City (TW)

(73) Assignee: Sunny Rich Agric. & Biotech Co., Ltd., Taipei City (TW)

( * ) Notice: Subject to any disclaimer, the term of this patent is extended or adjusted under 35 U.S.C. 154(b) by 365 days.

(21) Appl. No.: 18/724,176

(22) PCT Filed: Jan. 14, 2022

(86) PCT No.: PCT/CN2022/071982
§ 371 (c)(1),
(2) Date: Dec. 12, 2024

(87) PCT Pub. No.: WO2023/133796
PCT Pub. Date: Jul. 20, 2023

(65) Prior Publication Data

US 2025/0326467 A1 Oct. 23, 2025

(51) Int. Cl.
*B63B 35/34* (2006.01)
*B63B 35/38* (2006.01)
*B63B 35/44* (2006.01)

(52) U.S. Cl.
CPC ..... *B63B 35/34* (2013.01); *B63B 35/38* (2013.01); *B63B 35/44* (2013.01); *B63B 2035/4453* (2013.01)

(58) Field of Classification Search
CPC ..... B63B 35/34; B63B 35/36; B63B 35/38; B63B 35/44; B63B 2035/4453; B63B 7/02; B63B 7/04
USPC ..... D12/316; 114/263, 266, 267
See application file for complete search history.

(56) References Cited

U.S. PATENT DOCUMENTS 3,179,076 A * 4/1965 Sheffield ..... B63B 35/34 441/35
3,659,540 A * 5/1972 Toby ..... B63B 35/34 114/266
3,760,754 A * 9/1973 Drummond ..... B63B 35/34 405/211

(Continued)

FOREIGN PATENT DOCUMENTS

FR 2116846 A5 * 7/1972
KR 20130124696 A * 11/2013 ..... B63B 35/38

(Continued)

*Primary Examiner* — Ajay Vasudeva
(74) *Attorney, Agent, or Firm* — Best & Flanagan LLP

(57) ABSTRACT

A water floating body device has a bottom plate with two adjacent concave portions; a cover plate; two end covers, and a downwards-concave joint groove. Each concave portion of the bottom plate has a bottom wall, inner side wall slanting obliquely inwards, and an outer side wall slanting obliquely outwards. The cover plate has two upper extension walls. The joint groove has a bottom wall, and obliquely inward-slanting side walls arranged on two side edges of the joint groove's bottom wall. The top edges of the joint groove's side walls have upper transverse walls connected to the cover plate's upper extension walls. The end covers are sheet-shaped bodies, and can seal two end positions after the cover plate and the bottom plate are combined. In this way, the present invention can have better floating stability, structural strength and volume reduction effect.

8 Claims, 10 Drawing Sheets

(56) References Cited

U.S. PATENT DOCUMENTS

| | | | | | |
|---|---|---|---|---|---|
| 6,145,463 | A * | 11/2000 | Zeilinger | ..... | B63B 35/38<br>405/219 |
| 6,871,607 | B2 * | 3/2005 | Trepanier | ..... | E02B 3/064<br>114/61.1 |
| 8,166,901 | B2 * | 5/2012 | Gerst | ..... | B63B 35/38<br>114/220 |
| 10,286,984 | B2 * | 5/2019 | Seravalli | ..... | B63B 35/44 |

FOREIGN PATENT DOCUMENTS

| | | | | | |
|---|---|---|---|---|---|
| KR | 20140036091 | A * | 3/2014 | ..... | H10F 19/00 |
| KR | 101562140 | B1 * | 10/2015 | ..... | B63B 35/34 |

* cited by examiner

WATER FLOATING BODY DEVICE

TECHNICAL FIELD

The present invention relates to a water floating body device and, more particularly, to a floating body with enhanced structural strength, floating stability, and reduced volume.

BACKGROUND TECHNIQUE

To enhance the use of water, a platform with floating bodies is generally disposed on water. The platform generally includes a rigid frame comprised of a plurality of rods. A solar power generating device or a fishery-related object can be disposed on the frame. A plurality of vertical hollow cylindrical floats is disposed below the frame, and the frame and objects on top of the frame can float on water through the floats.

SUMMARY OF THE INVENTION

Technical Problem

The above-mentioned single cylindrical float disposed on water tends to rotate and drift and, thus, has poor stability. Therefore, it is necessary to assemble a plurality of cylindrical floats. However, the cylindrical floats are difficult to be assembled with the outer frame. The assembly is inconvenient and the assembling stability is not good. Furthermore, each cylindrical float per se cannot be detached, such that the floating body has a large volume, which is disadvantageous to loading and transportation.

Currently, there are floating bodies produced by blow molding. However, the floating bodies have a high manufacturing cost and a large volume, leading to defect of difficulties in transportation and storage. Furthermore, currently, there are floating bodies produced by lumpy foam. However, the lumpy foam has a low structural strength and is difficult to assemble with an outer frame. Furthermore, the foam has a large volume, leading to defects of occupation of a large volume and disadvantageous to loading and transportation.

SOLUTION OF PROBLEM

Technical Solution

An objective of the present invention is to provide a floating body with enhanced structural strength, floating stability, and reduced volume.

The present invention comprises a bottom plate, a cover plate, and two end covers. The bottom plate is a rectilinear object and has two recessed portions adjacent to each other. The two recessed portions has a spacing area therebetween. Furthermore, each recessed portion has a lower bottom wall. Two edges of the lower bottom wall are respectively provided with an outwardly extending inclined inner lower sidewall and an outwardly extending inclined outer lower sidewall. The inner lower sidewalls of the two recessed portions are adjacent to each other. The height of the inner lower sidewall is lower than the outer lower sidewall. Furthermore, a horizontal lower connecting wall is disposed between top ends of the two inner lower sidewalls. Furthermore, the two outer lower sidewalls are provided with lower extension walls extending outward and horizontally. Furthermore, the cover plate is disposed on top of the bottom plate and may sealingly close upper ends of the two recessed portions. The cover plate is a rectilinear object, is provided with two upper extension walls respectively located corresponding to the two lower extension walls, and is provided with a downwardly recessed coupling groove which is located corresponding to the lower connecting wall and which corresponds to a longer side. The coupling groove includes an upper bottom wall which can abut the lower connecting wall. Each of two edges of the upper bottom wall is provided with an outwardly extending inclined inner upper sidewall. A top edge of each of the two inner upper sidewalls is provided with an outwardly extending upper lateral wall. The upper lateral wall is connected with the upper extension wall. Furthermore, the two end covers are sheet-like objects and may sealingly close two ends of the cover plate which has been assembled with the bottom plate, and with the bottom plate, the cover plate, and the two end covers assembled to form a floating body having a hollow portion.

Furthermore, the upper lateral wall includes an outer edge provided with an outer upper sidewall which extends downwardly and outwardly and which is connected to the upper extension wall.

Furthermore, a side of the end cover is provided with an outer edge abutting outer surfaces of the ends of the bottom plate and the cover plate.

Furthermore, an inner face of the end cover is provided with ribs.

Furthermore, an inner surface of the end cover is provided with an inner edge abutting inner sides of the ends of the bottom plate and the cover plate.

Furthermore, an inner face of the end cover is provided with insertion grooves into which the ends of the bottom plate and the cover plate are inserted.

Furthermore, waterproof pads are included, and the waterproof pads are disposed in the insertion grooves of the end cover.

Furthermore, the end cover is provided with a lateral coupling groove corresponding to a vertical direction of the coupling groove and intersecting with the coupling groove.

ADVANTAGEOUS EFFECTS OF THE INVENTION

Advantageous Effects

By adopting the above solution, in the present invention, plural bottom plates and plural cover plates can be stacked to significantly reduce the volume while allowing easy transportation and storage.

The coupling groove of the cover plate of the present invention may be coupled with end portions of an outer frame, which can to provide enhanced assembling convenience and stability for the floating body and the outer frame. Furthermore, when disposed on water, the present invention can float on the water surface by the two corresponding recessed portions at the same time, which provides greater returning force and enhanced floating stability. Furthermore, swaying of the object loaded on the top side of the floating body is reduced to provide more stable floating effect.

BRIEF DESCRIPTION OF THE ACCOMPANYING DRAWINGS

Description of the Accompanying Drawings

REFERENCE NUMBERS

1 bottom plate, 10 hollow portion, 11 recessed portion, 12 spacing area, 13 lower bottom wall, 14 inner lower sidewall, 15 outer lower sidewall, 16 lower connecting wall, 17 lower extension wall, 2 cover plate, 21 upper extension wall, 22 coupling groove, 23 upper bottom wall, 24 inner upper sidewall, 25 upper lateral wall, 26 outer upper sidewall, 27 lateral coupling groove, 3 end cover, 31 outer edge, 32 rib, 33 inner edge, 34 insertion groove, 35 waterproof pad, 4 frame, 41 engaging member, 5 water, 51 water surface

EMBODIMENTS OF THE INVENTION

Implementation of the Present Invention

Figure 2:
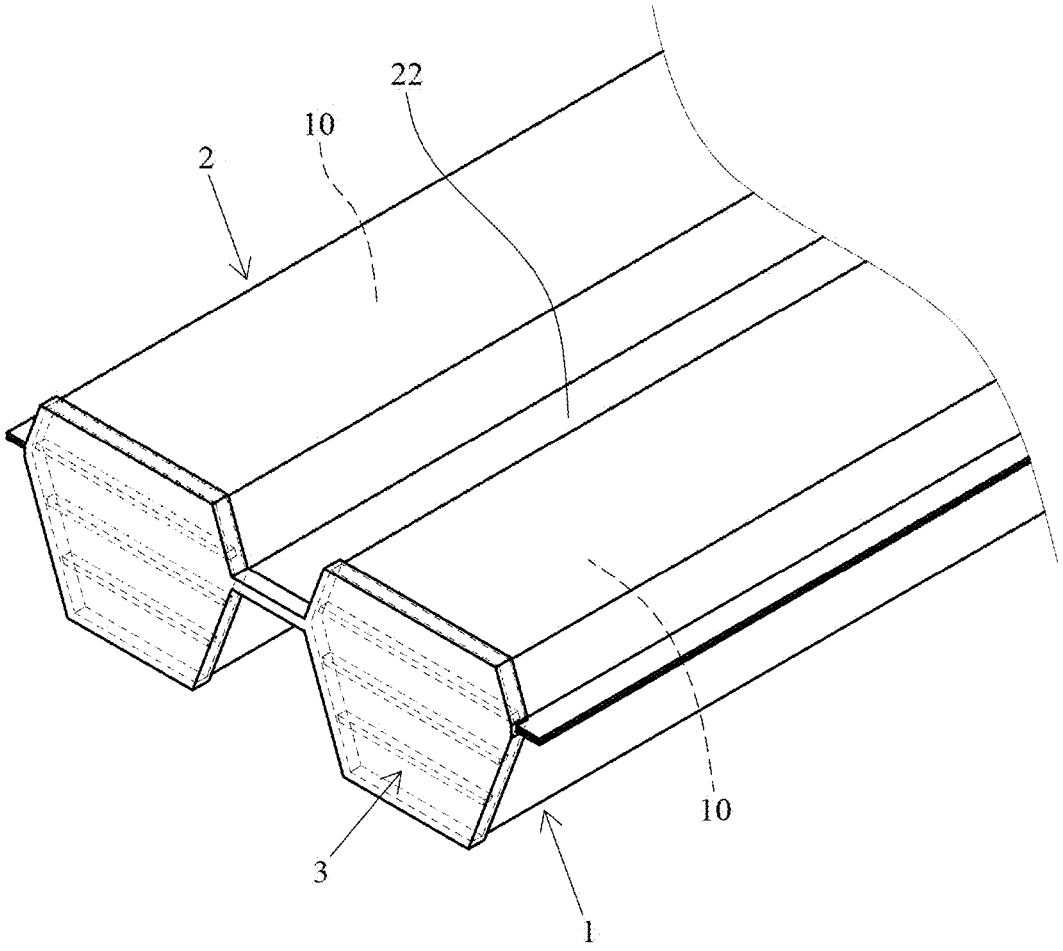
FIG. 2 is a partial, assembled view of the first embodiment of the present invention.
Figure 3:
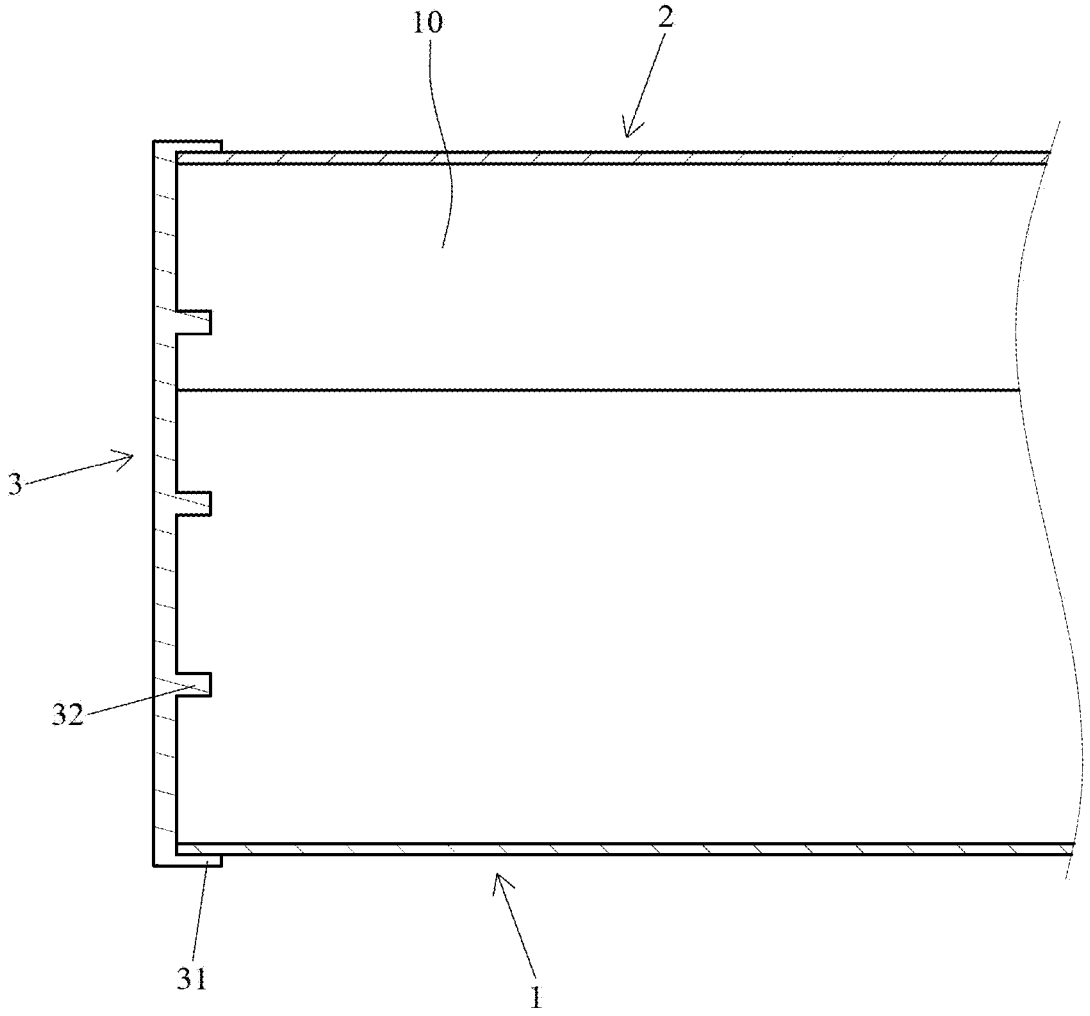
FIG. 3 is a partial, assembled, cross sectional view of the first embodiment of the present invention.

Elements having the same functions in the present invention are designated by the same reference number in the following embodiments. Please refer to FIGS. 1-3 which show a first embodiment of the present invention. The first embodiment comprises a bottom plate 1, a cover plate 2, and two end covers 3 (one end cover 3 is shown in the drawings). The bottom plate 1 may be made of plastic material and may be formed by squeezing or extrusion to enhance the manufacturing efficiency. The bottom plate 1 is a rectilinear object and has two recessed portions 11 adjacent to each other. The two recessed portions 11 have a spacing area 12 therebetween. Furthermore, each recessed portion 11 has a horizontal lower bottom wall 13. Two edges of the lower bottom wall 13 are respectively provided with an outwardly extending inclined inner lower sidewall 14 and an outwardly extending inclined outer lower sidewall 15. The inner lower sidewalls 14 of the two recessed portions 11 are adjacent to each other. The height of the inner lower sidewall 14 is lower than the outer lower sidewall 15. A horizontal lower connecting wall 16 is disposed between top ends of the two inner lower sidewalls 14. Furthermore, the two outer lower sidewalls 15 are provided with lower extension walls 17 extending outward and horizontally;

The cover plate 2 may be made of plastic material and may be formed by squeezing or extrusion to enhance the manufacturing efficiency. The cover plate 2 is disposed on top of the bottom plate 1 and may sealingly close upper ends of the two recessed portions 11. The cover plate 2 is a rectilinear object, is provided with two upper extension walls 21 respectively located corresponding to the two lower extension walls 17, and provided with a downwardly recessed coupling groove 22 which is located corresponding to the lower connecting wall 16 and which corresponds to a longer side. The coupling groove 22 includes an upper bottom wall 23 which can abut the lower connecting wall 16. Each of two edges of the upper bottom wall 23 is provided with an outwardly extending inclined inner upper sidewall 24. A top edge of each of the two inner upper sidewalls 24 is provided with an outwardly extending upper lateral wall 25. The upper lateral wall 25 includes an outer edge provided with an outer upper sidewall 26 which extends downwardly and outwardly and which is connected to the upper extension wall 21.

The end covers 3 may be made of plastic material and in the form of sheet-like objects and may sealingly close two ends of the cover plate 2 which has been assembled with the bottom plate 1. The bottom plate 1, the cover plate 2, and the two end covers 3 are assembled to form a floating body having a hollow portion. A side of the end cover 3 is provided with an outer edge 31 abutting outer surfaces of the ends of the bottom plate 1 and the cover plate 2. An inner face of the end cover 3 is provided with ribs 32.

Figure 1:
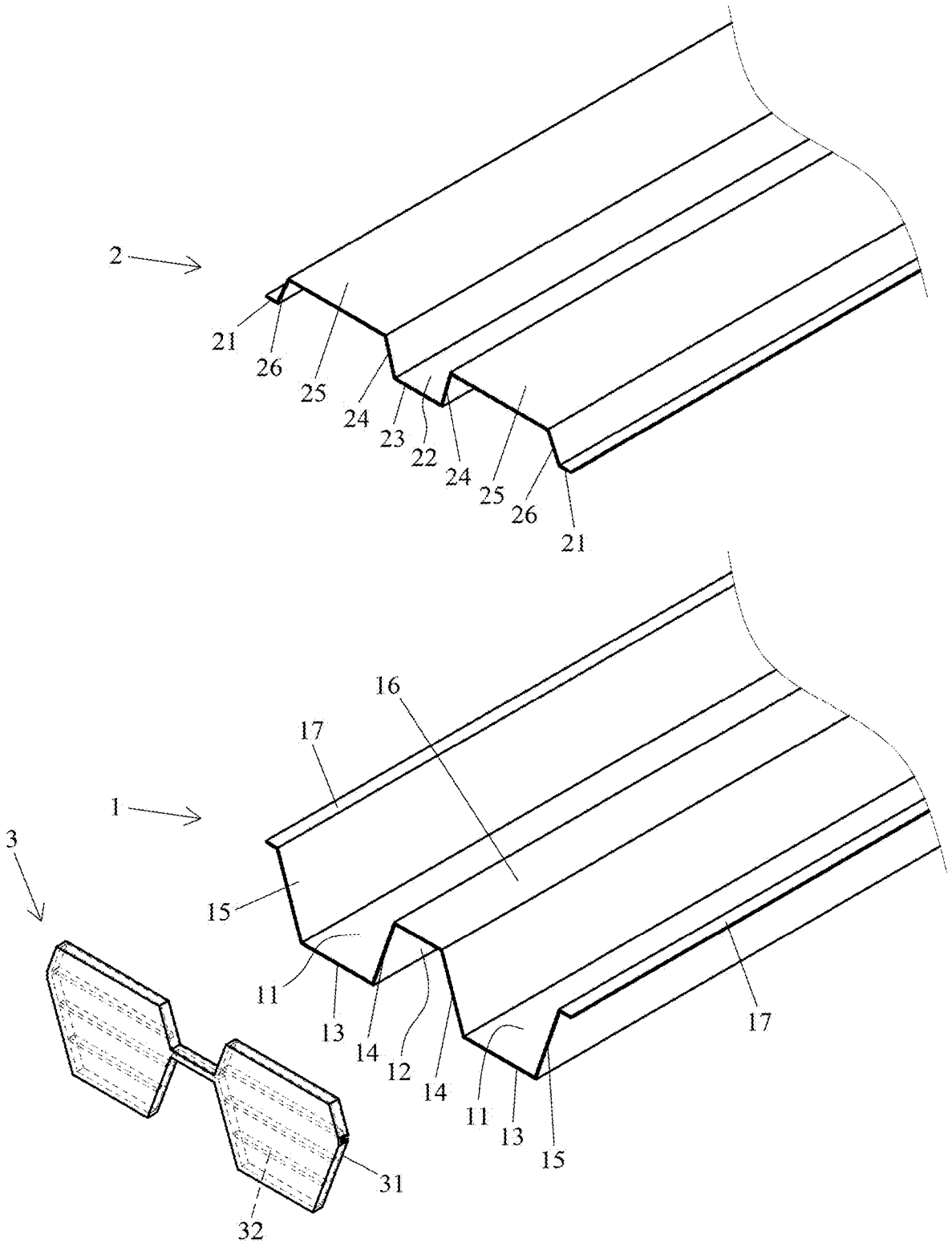
FIG. 1 is a partial, exploded, perspective view of a first embodiment of the present invention.
Figure 4:
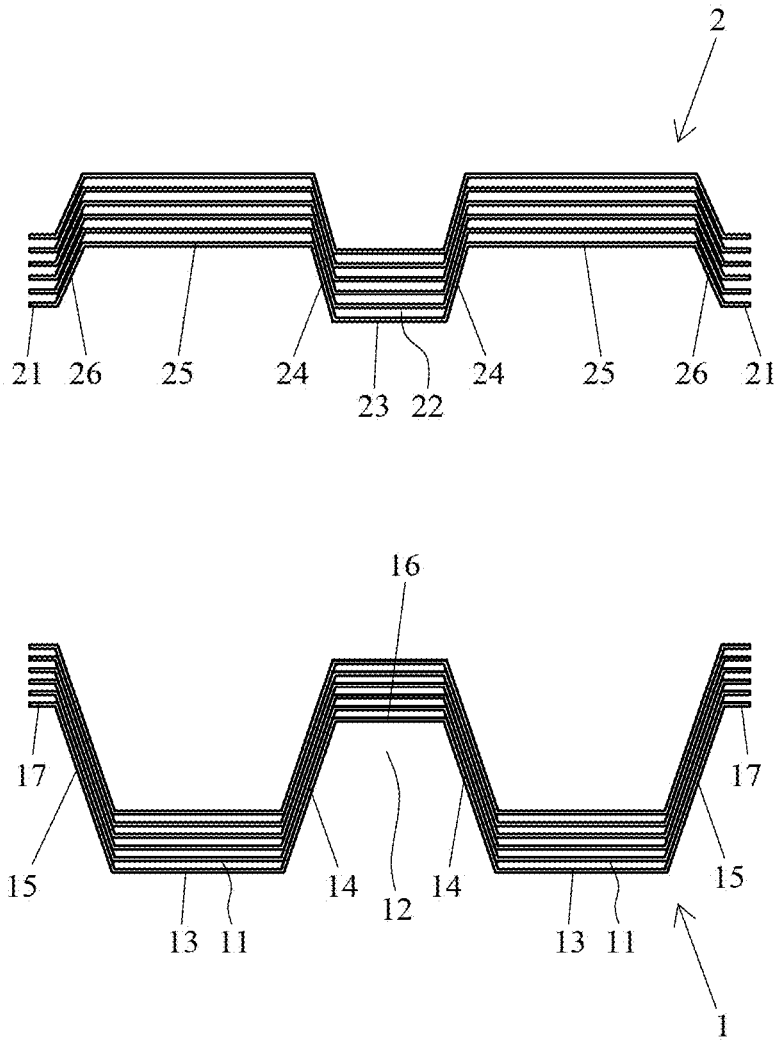
FIG. 4 is a schematic view illustrating stacking of plural bottom plates and plural cover plates of the first embodiment of the present invention.

With reference to FIGS. 1 and 4, in the present invention, plural bottom plates 1 may be stacked vertically through the inclination design of the inner lower sidewalls 14 and the outer lower sidewalls 15. Furthermore, plural cover plates 2 may be stacked easily by the inclination design of the inner upper sidewalls 24 and the outer upper sidewalls 26. Thus, the volume can be significantly reduced while permitting easy transportation and storage. Furthermore, the end covers 3 have a small thickness and are, thus, easy to stack (not illustrated).

In the present invention, the cover plate 2 can cover the bottom plate 1, the upper and lower extension walls 21 and 17 abut each other, and the upper bottom wall 23 and the lower connecting wall 16 abut each other. Then, waterproof glue (not shown) or other sealing elements are provide to provide secure sealing. Furthermore, the two end covers 3 are respectively installed on two ends of the bottom plate 1 and two ends of the cover plate 2, and the outer edges 31 abut the bottom plate 1 and the cover plate 2 and are then fixed by waterproof glue (not shown) or other sealing elements. Thus, a floating body with buoyancy and having a sealed hollow portion 10 can be formed. Furthermore, the bottom plate 1 and the cover plate 2 of the present invention have several bends at different angles, and the end covers 3 have the design of ribs 32, thereby possessing excellent anti-torque structural strength and impact resistance.

Figure 5:
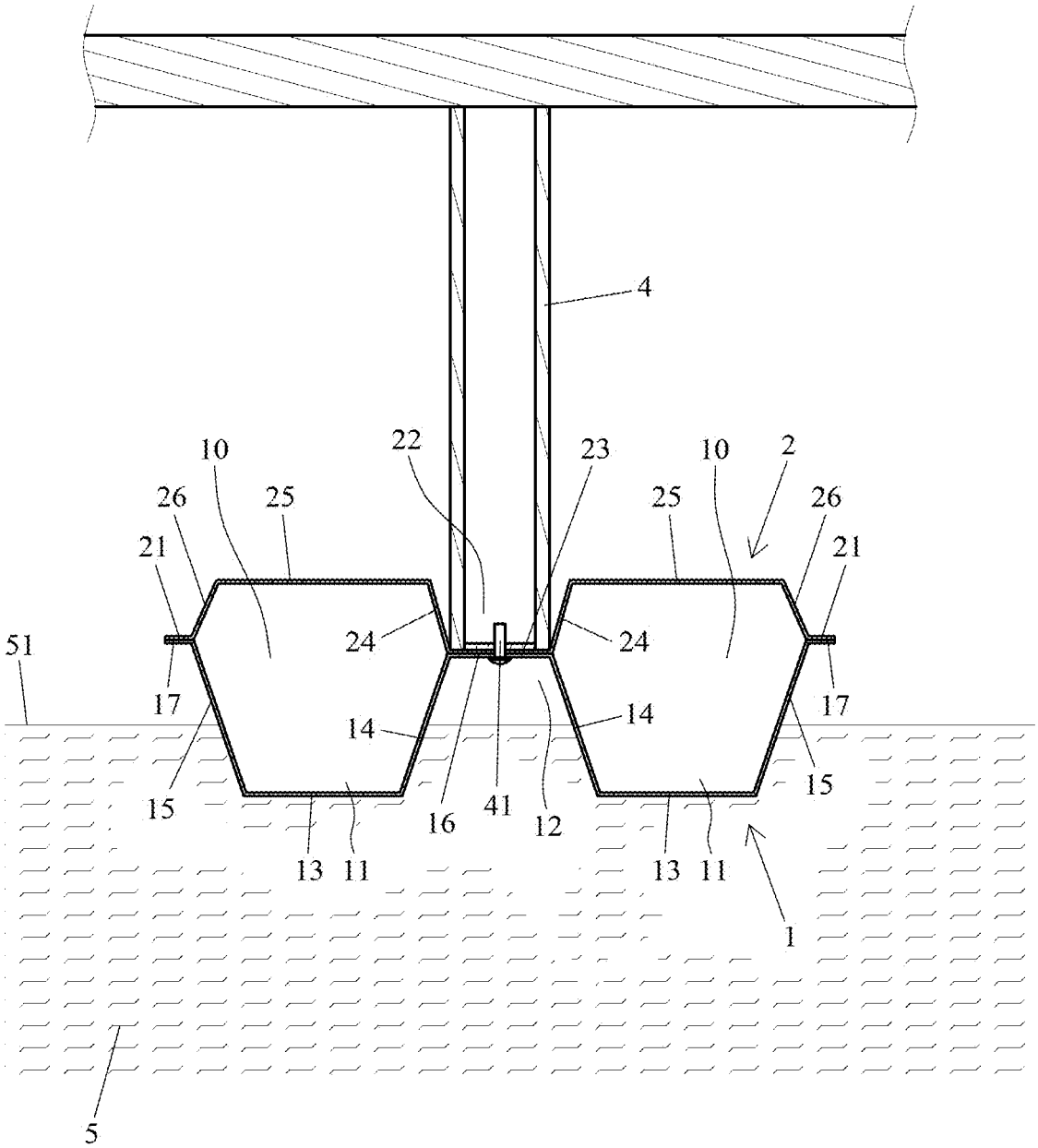
FIG. 5 is a schematic view illustrating installation of the first embodiment of the present invention coupled with an outer frame and disposed on water.

With reference to FIG. 5, the coupling groove 22 of the cover plate 2 of the present invention permits insertion of end portions of an outer frame 4. The bottom edges of the inner upper sidewalls 24 may abut the outer frame 4, and engaging members 41 extend through the upper bottom wall 23 and the lower connecting wall 16 to engage with the frame 4. This provides the floating body and the outer frame 4 with enhanced assembling convenience and stability. Furthermore, when disposed on water 5, the present invention can float on the water surface by the two corresponding recessed portions 11 at the same time, which provides a greater returning torque. Furthermore, the spacing area 12 can reduce wave impact, reduce the contact area with water 5 and contact resistance, which can enhance the floating stability. Furthermore, when subjected to water waves, swaying of the object loaded on the top side of the floating body is reduced to provide more stable floating effect.

Figure 6:
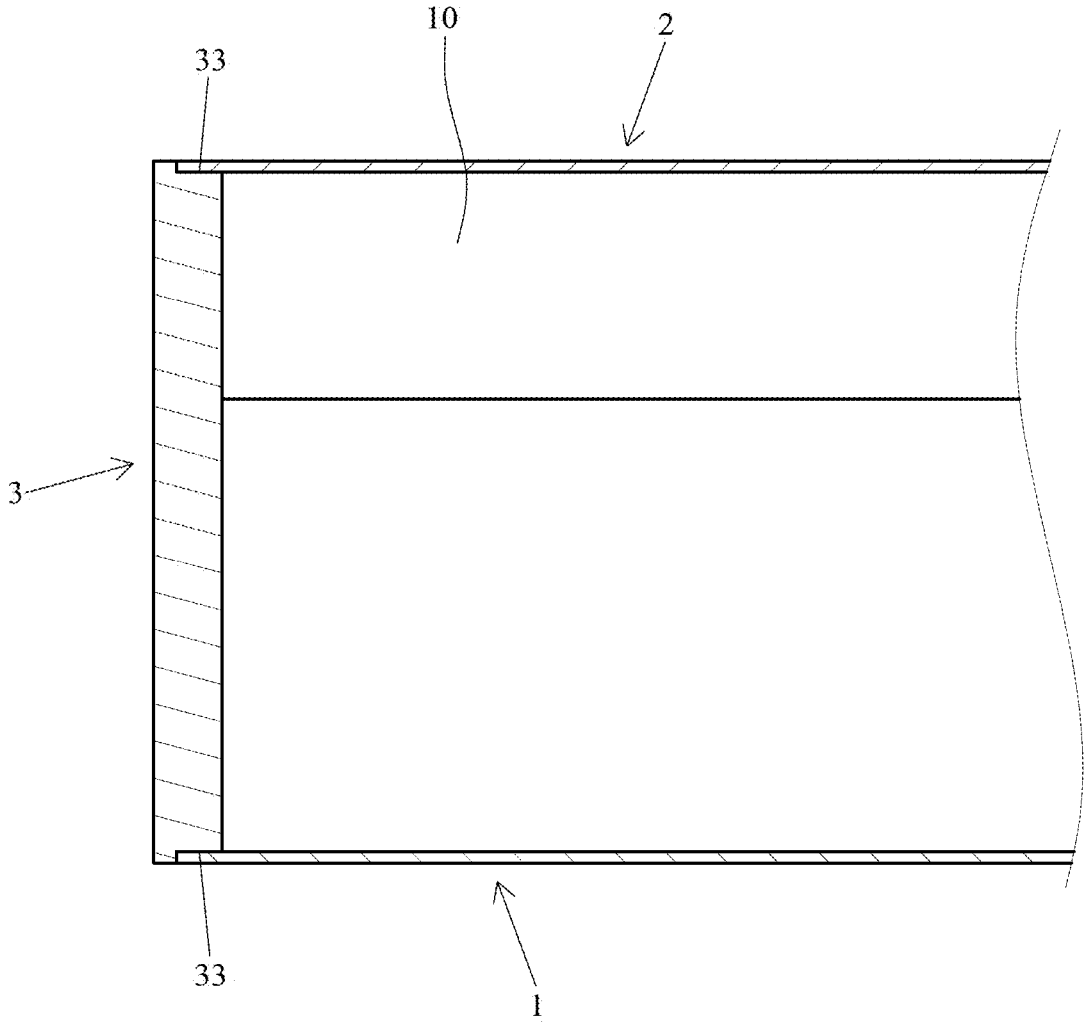
FIG. 6 is an assembled, cross sectional view of an end cover of a second embodiment of the present invention.

Please refer to FIG. 6 showing a second embodiment of the present invention. The second embodiment is similar to the first embodiment. The main difference resides in that the inner surface of the end cover 3 is provided with an inner edge 33 abutting inner sides of the ends of the bottom plate 1 and the cover plate 2. The inner edge 33 may be securely coupled with the bottom plate 1 and the cover plate 2 by waterproof glue (not shown) or other engaging members, providing excellent sealing effect.

Figure 7:
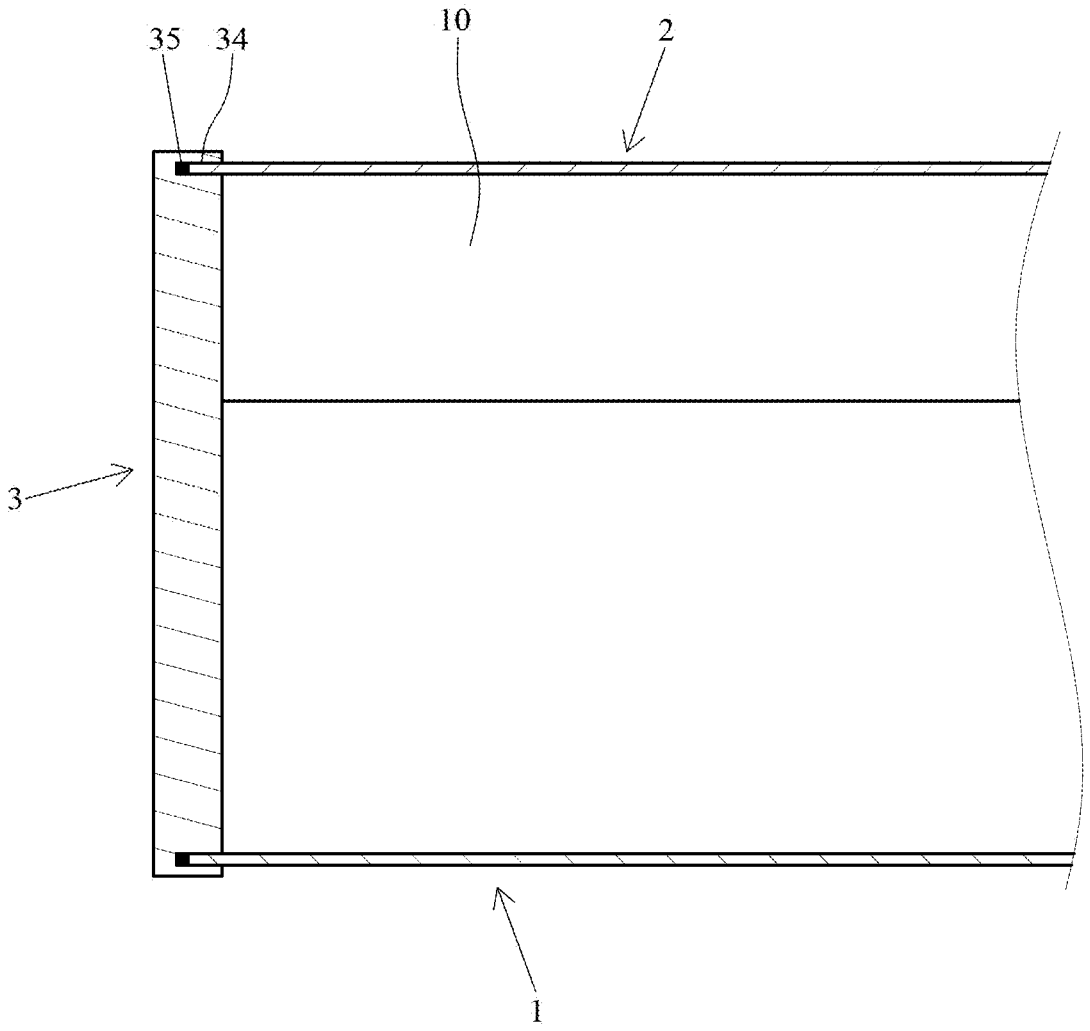
FIG. 7 is an assembled, cross sectional view of an end cover of a third embodiment of the present invention.

Please refer to FIG. 7 showing a third embodiment of the present invention. The third embodiment is similar to the first embodiment. The main difference resides in that the inner face of the end cover 3 is provided with insertion grooves 34 into which the ends of the bottom plate 1 and the cover plate 2 are inserted. Furthermore, waterproof pads 35 are disposed in the insertion grooves 34 of the end cover 3. After the end covers 3 are coupled with the bottom plate 1 and the cover plate 2, waterproof glue (not shown) or other engaging members may be provided to securely couple with the bottom plate 1 and the cover plate 2, and the waterproof pads 35 provide excellent sealing effect.

Figure 8:
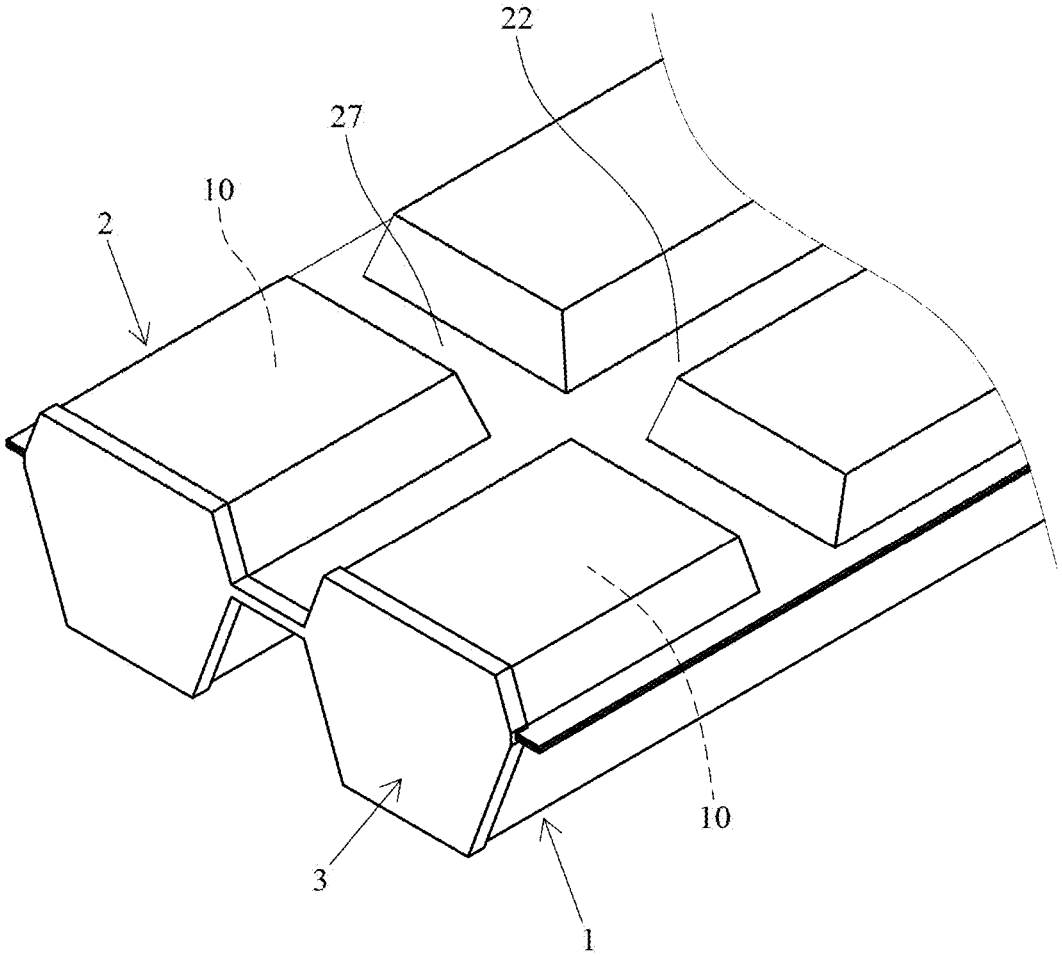
FIG. 8 is a partial, assembled, perspective view of a floating body of a fourth embodiment of the present invention.
Figure 9:
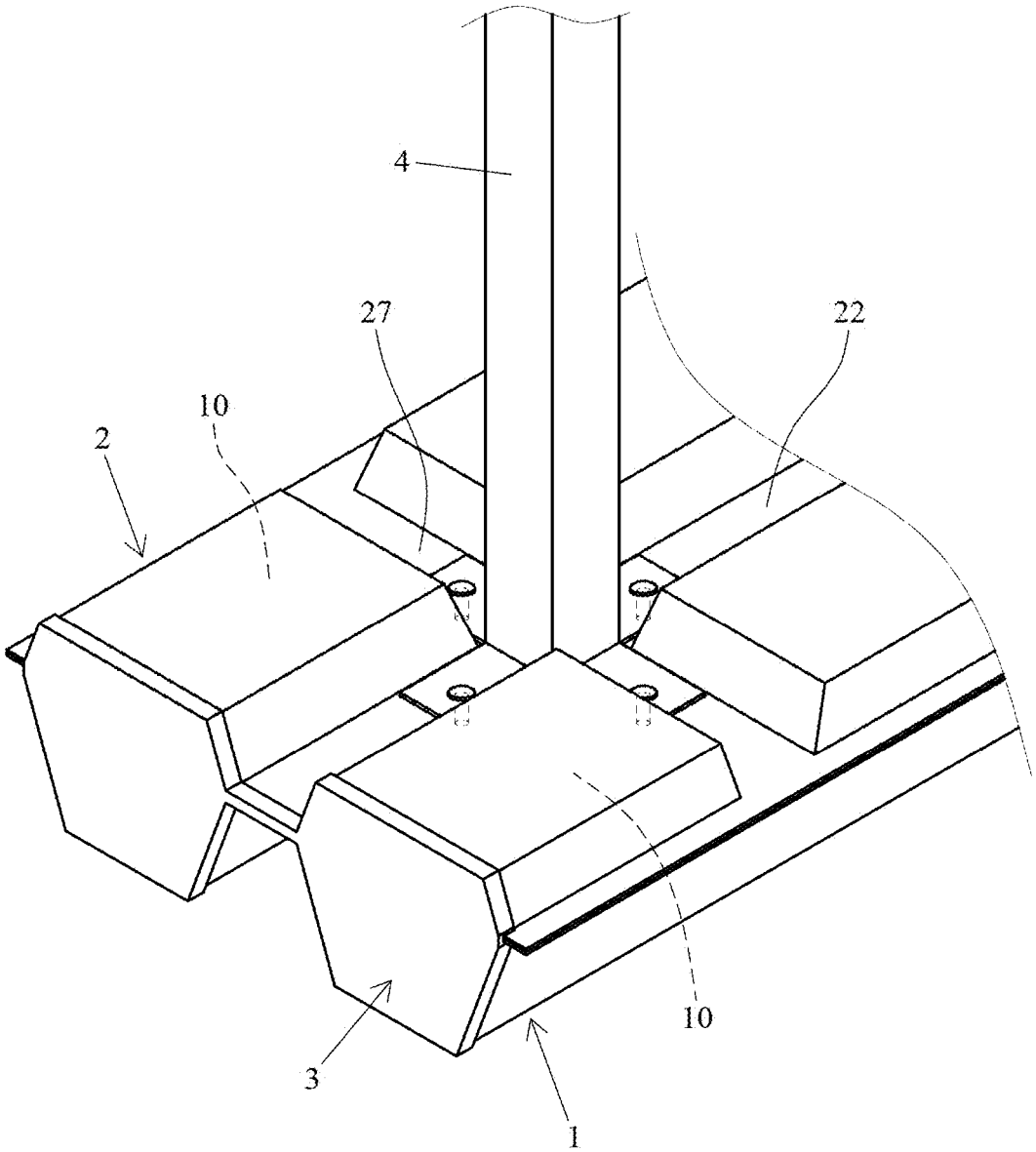
FIG. 9 is an assembled perspective view of a floating body of the fourth embodiment the present invention and a frame.

Please refer to FIGS. 8 and 9 showing a fourth embodiment of the present invention. The fourth embodiment is similar to the first embodiment. The main difference resides in that the cover plate 2 is provided with a lateral coupling groove 27 corresponding to a vertical direction of the coupling groove 22 of the cover plate 2 and intersecting with the coupling groove 22. The lateral coupling groove 27 increases the strength of the cover plate 2. Furthermore, the coupling groove 22 and the lateral coupling groove 27 can couple with an outer frame 4 with a cruciform bottom end, which can enhance assembling stability of the floating body and the frame 4.

Figure 10:
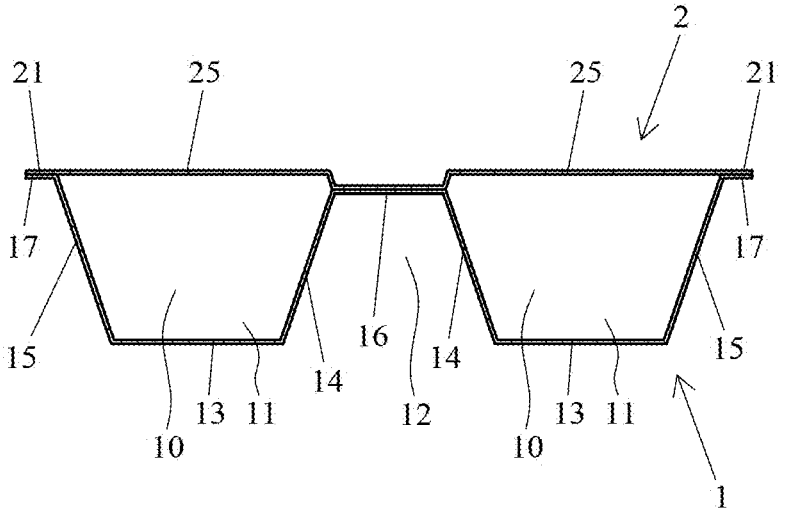
FIG. 10 is a cross sectional view of a structure of a fifth embodiment of the present invention.

Please refer to FIG. 10 showing a fifth embodiment of the present invention. The fifth embodiment is similar to the first embodiment. The main difference resides in that the cover plate 2 does not include the outer upper sidewalls 26 on FIG. 1, and the upper lateral walls 25 are coplanar with the upper extension walls 21. The volume of the hollow portion 10 of the floating body is smaller than the first embodiment and may provide the same function similar to the first embodiment.

Therefore, based on the above description, the present invention is a novel design of a float and provides the effects of enhanced floating stability, enhanced structural strength and reduced volume. Furthermore, the foregoing embodiments are examples of the present invention, not limitation to the present invention. All equivalent changes made in accordance with the spirit of the present invention should also fall within the scope of the present invention.

The invention claimed is:

1. A water floating body device, characterized by comprising:

a bottom plate which is a rectilinear object and has two recessed portions adjacent to each other, with the two recessed portions having a spacing area therebetween, with each recessed portion having a lower bottom wall, with two edges of the lower bottom wall respectively provided with an outwardly extending inclined inner lower sidewall and an outwardly extending inclined outer lower sidewall, with the inner lower sidewalls of the two recessed portions being adjacent to each other, with a height of the inner lower sidewall being lower than the outer lower sidewall, with a horizontal lower connecting wall disposed between top ends of the two inner lower sidewalls, and with the two outer lower sidewalls provided with lower extension walls extending outward and horizontally;

a cover plate disposed on top of the bottom plate and sealingly closing upper ends of the two recessed portions, with the cover plate being a rectilinear object and provided with two upper extension walls respectively located corresponding to the two lower extension walls and provided with a downwardly recessed coupling groove which is located corresponding to the lower connecting wall and which corresponds to a longer side, with the coupling groove including an upper bottom wall abutting the lower connecting wall, with each of two edges of the upper bottom wall provided with an outwardly extending inclined inner upper sidewall, with a top edge of each of the two inner upper sidewalls provided with an outwardly extending upper lateral wall, and with the upper lateral wall connected with the upper extension wall;

two end covers which are sheet-like objects and which sealingly close two ends of the cover plate which has been assembled with the bottom plate, and with the bottom plate, the cover plate, and the two end covers assembled to form a floating body having a hollow portion.

2. The water floating body device as set forth in claim 1, characterized in that the upper lateral wall includes an outer edge provided with an outer upper sidewall which extends downwardly and outwardly and which is connected to the upper extension wall.

3. The water floating body device as set forth in claim 1, characterized in that a side of the end cover is provided with an outer edge abutting outer surfaces of the ends of the bottom plate and the cover plate.

4. The water floating body device as set forth in claim 3, characterized in that an inner face of the end cover is provided with ribs.

5. The water floating body device as set forth in claim 1, characterized in that an inner surface of the end cover is provided with an inner edge abutting inner sides of the ends of the bottom plate and the cover plate.

6. The water floating body device as set forth in claim 1, characterized in that an inner face of the end cover is provided with insertion grooves into which the ends of the bottom plate and the cover plate are inserted.

7. The water floating body device as set forth in claim 6, characterized by further comprising waterproof pads, with the waterproof pads disposed in the insertion grooves of the end cover.

8. The water floating body device as set forth in claim 1, characterized in that the end cover is provided with a lateral coupling groove corresponding to a vertical direction of the coupling groove and intersecting with the coupling groove.

* * * * *